US006357653B1

(12) United States Patent
Murcia

(10) Patent No.: US 6,357,653 B1
(45) Date of Patent: Mar. 19, 2002

(54) WOOD CHARCOAL CONTAINER

(76) Inventor: Philippe R. Murcia, 19 Cobblefield La., White Plains, NY (US) 10605

( * ) Notice: Subject to any disclaimer, the term of this patent is extended or adjusted under 35 U.S.C. 154(b) by 0 days.

(21) Appl. No.: 09/820,583

(22) Filed: Mar. 29, 2001

(51) Int. Cl.[7] ..... B65D 5/72; B65D 25/38

(52) U.S. Cl. ..... 229/122.1; 221/305; 222/531; 222/556; 222/566

(58) Field of Search ..... 229/122.1; 221/305; 222/460, 461, 469, 527, 528, 529, 531, 533, 534, 535, 556, 557, 566

(56) References Cited

U.S. PATENT DOCUMENTS

| | | | | | |
|---|---|---|---|---|---|
| 181,014 | A | * | 8/1876 | Scott | 222/566 |
| 327,580 | A | * | 10/1885 | Norton | 222/566 |
| 1,546,600 | A | * | 7/1925 | Morris | 222/531 |
| 1,988,064 | A | * | 1/1935 | Wiemann | 229/122.1 |
| 2,786,612 | A | * | 3/1957 | Gallo | 222/531 |
| 3,187,961 | A | * | 6/1965 | Moore | 222/556 |
| 3,484,034 | A | * | 12/1969 | Sternau | 222/531 |
| 3,850,362 | A | * | 11/1974 | Stollberg et al. | 229/117.06 |
| 4,239,149 | A | * | 12/1980 | Kupersmit | 229/125.21 |
| 4,572,408 | A | * | 2/1986 | Kupersmit | 222/528 |
| 4,602,735 | A | * | 7/1986 | Aaron | 221/305 |
| 5,253,789 | A | * | 10/1993 | Mateko | 222/556 |
| 5,611,447 | A | * | 3/1997 | Tye | 220/2 |

FOREIGN PATENT DOCUMENTS

| | | | | |
|---|---|---|---|---|
| GB | 2234495 | A | * 2/1991 | 229/122.1 |

* cited by examiner

*Primary Examiner*—Gary E. Elkins
(74) *Attorney, Agent, or Firm*—Corbrin & Gittes

(57) ABSTRACT

A container that holds wood charcoal. The container has a collapsible spout that is positioned so that, when the container is tipped, wood charcoal pours out when the spout is in the fully extended position. The spout is collapsible to close an opening in a front face to facilitate storage. A handle is provided at the top to facilitate grasping while pouring out the wood charcoal.

4 Claims, 4 Drawing Sheets

WOOD CHARCOAL CONTAINER

BACKGROUND OF THE INVENTION

1. Field of the Invention

The invention relates to a container suited to store and pour wood charcoal.

2. Discussion of Related Art

Conventionally, charcoal briquettes are packaged in paper bags. As is known conventionally, the paper bags are not resistant to moisture (rain) or tearing. They are difficult to clean of accumulated charcoal dust and dirt. In addition, the bag is awkward to transport and store due to its odd shape.

U.S. Pat. No. 5,611,447 recognized these problems and proposed a reusable molded plastic container for storage and transportation of materials used with a charcoal dependent cooker. It has a handle at the top and lids that open at either side of the handle to allow charcoal to be poured out. Other compartments are provided on the container to hold items such as utensils, lighter fluid, matches, cooking gloves, hot pads. The charcoal briquettes are chemically treated and formed under pressure to provide a hard outer surface.

Unlike conventional charcoal briquettes, wood charcoal on the other hand is friable. As a result, storing wood charcoal in the same type of paper bags that charcoal briquettes are stored is even more problematic. When the paper bag is exposed to externally applied forces, the wood charcoal inside is much more susceptible to crumbling or being pulverized than is the case with charcoal briquettes. Even pouring the wood charcoal through the mouth of the bag causes jostling of the wood charcoal is a significant manner, i.e., turning the bag nearly 180 degrees to pour out the wood charcoal. Such jostling causes the friable wood charcoal to rub against each other, easily causing crumbling.

The teaching of the plastic container of U.S. Pat. No. 5,611,447, if applied to wood charcoal, would be an improvement over the paper bag since the plastic container would better protect the wood charcoal from externally imposed forces. Nevertheless, the plastic container has an opening at the top, thereby requiring that the container be turned nearly 180° to pour out the charcoal. In addition, where the extra compartment space for holding barbeque related items is not needed, such is wasted space. Further, since its pouring opening is stationary (only the lid opens), it is not as compact as it could be for storage purposes.

U.S. Pat. No. 4,572,408 reveals a pour spout construction for collapsible containers. It relates to the field of shipping containers for transporting bulky cargo such as bulk particulate materials. It recognizes that such containers would benefit by the presence of a large pour spout localized at or near the bottom of the container in a side wall. Spouts that are constructed of light weight stamped sheet metal hingedly connected at an inner end to an edge of an opening in a container wall are unsuitable for use such shipping containers. The reason is that the side walls of the spout enter the enclosed volume of the container when the spout is closed. If such a hinged spout were placed at the lower edge of a side wall of a large loaded container, the particulate material, under pressure of its own weight contacts the surfaces of the spout, creating sufficient friction to effectively prevent the withdrawal of the spout to the opened condition. Therefore, the patent proposes use of collapsible spout made of foldable fibrous material, parts of which are interconnected within an opening in a side wall of the container. When folded, the spout does not project into the interior of the container and, accordingly, does not interfere with the collapsing of the container when empty.

BRIEF SUMMARY OF THE INVENTION

The present invention is a container for transporting and storing wood charcoal. The container is preferably box-shaped, with an opening in a bottom half of the front face. A collapsible spout is connected at the opening and movable between an inward position that closes the opening and an outward position that extends the spout outwardly clearing the opening to permit contents of the container to be poured out through the opening and along the spout. A handle is positioned centrally at the top of the container. Since the spout in the inward position closes the opening, but does not enter the opening, its sidewalls will not cut into any wood charcoal within and further will not be blocked by any wood charcoal adjacent the opening that is inside the container. Since no portion of the spout extends appreciably inwardly, the weight of the wood charcoal will not press against it in such a manner as to prevent the spout from being moved into its outward position. Also, the spout, being collapsible, will not interfere with the folding of the container when empty.

BRIEF DESCRIPTION OF THE SEVERAL VIEWS OF THE DRAWING

For a better understanding of the present invention, reference is made to the following description and accompanying drawings, while the scope of the invention is set forth in the appended claims.

DETAILED DESCRIPTION OF THE INVENTION

Figure 1:
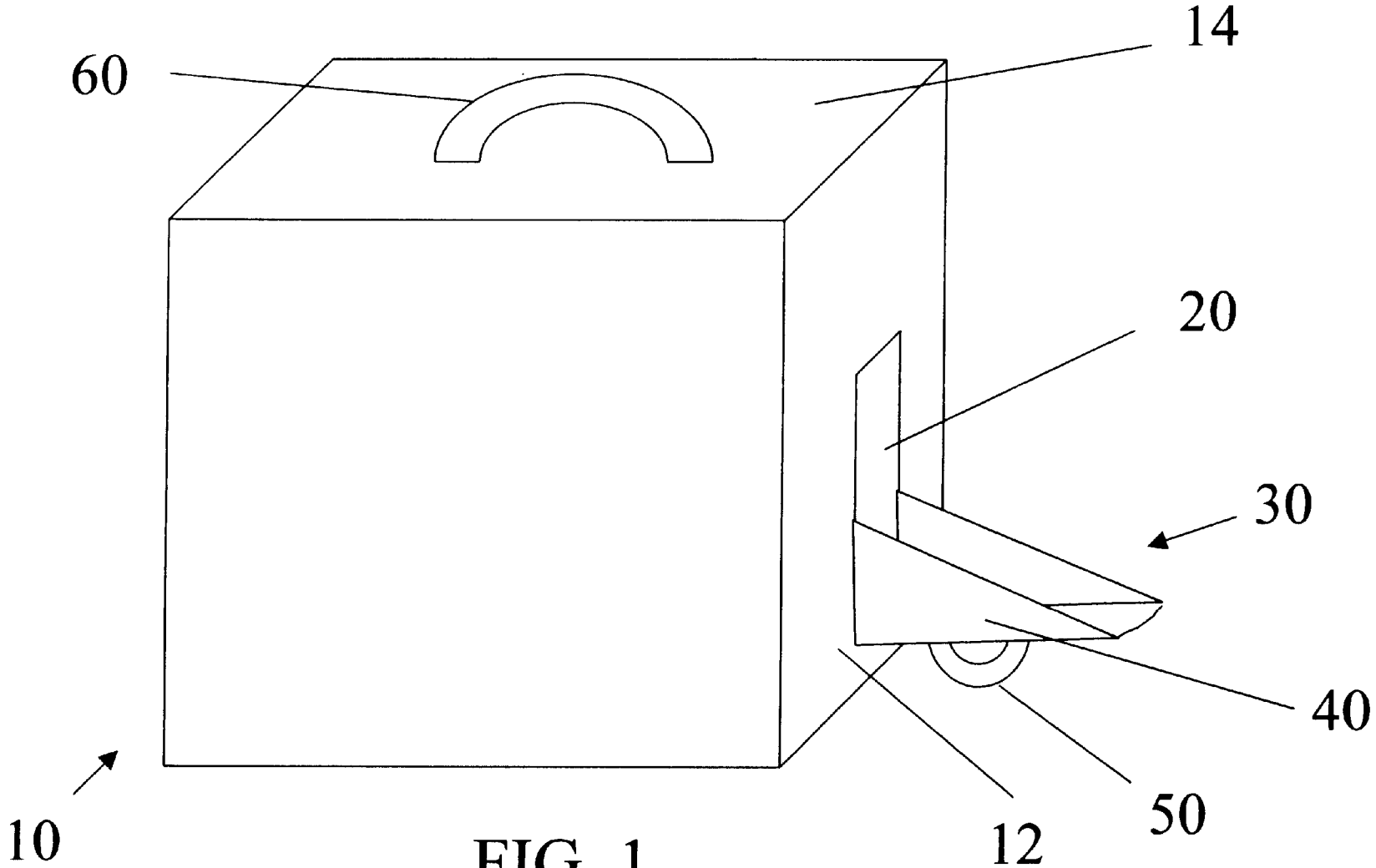
FIG. 1 is a perspective side view of the wood charcoal container in accordance with an embodiment of the invention.

Turning to the drawing, FIG. 1 shows a wood-charcoal container 10 for storing wood-charcoal. The container 10 may be of a box-shape, preferably constructed of corrugated cardboard, although other materials such as plastic, metal, wood, some other material having semi-rigid form, or any combination. During the packaging process, wood charcoal may be placed inside the container in a variety of ways. For example, the container 10 may be constructed so that all of the walls forming the container compartment are in place except a particular side wall. Instead, inwardly directly flaps extend where the particular side wall would otherwise be but only close a relatively small portion of the open side. Wood charcoal may be placed in the container 10. After the charcoal has been placed in the container, the side wall may be attached to the container 10 using an adhesive on the flaps and/or on portions of the side wall that will rest on the flaps.

In an alternative embodiment, the same process may be utilized substituting the top wall 14 for the side wall. In yet another alternative embodiment, the top wall 14 may be constructed of flaps capable of opening outwards and closing inward to engage each other in a complementary manner so as to remain in the engaged position. During packaging, the flaps may be opened, and wood charcoal may be placed inside. Once the container has been filled with the wood charcoal, the flaps are closed to engage each other and thus remain in the engaged position.

The container 10 may also have an opening 20 in a particular wall from which wood charcoal may exit from the container. For exemplary purposes, FIG. 1 illustrates such an opening 20 in front wall 12. This opening 20 may be covered by collapsing a spout 30 when the container is not being used.

The opening 20 is preferably located in a bottom half of the front wall 12 and thereby closer to the bottom wall than to the top wall 14. This positioning lessens the amount of tilting necessary to pour out wood charcoal than would be the case if the opening were higher. In addition, wood charcoal located against the inside of the bottom half of the front wall 12 is more easily poured out than would be the case if the opening 20 were at a higher elevation.

The spout 30 may have two flexible guide walls 40 which form a spout channel so as to prevent wood charcoal from spilling out uncontrollably as it exits from the container. The wood charcoal may exit out the opening, through the spout channel, and into a receptacle of some sort. Preferably, the guide walls are made of corrugated cardboard or paper. The base between the guide walls 40 may be made of corrugated cardboard.

The container 10 may have a handle 50 attached to the spout 30 to assist with the opening and closing of the spout. The handle 50 is preferably made of a flexible material, such as corrugated cardboard.

The container 10 may also have attached to it a handle 60 so that the container 10 may be easily carried, tilted, or handled. The handle 60 is connected to the container, preferably at the side walls or on the top as shown in FIG. 1, and defines a space between itself and the top 14 of the container 10. The handle 60 needs to be made of a sturdy material to support the weight of the container when fully loaded with wood charcoal. Similarly, the attachment of the handle 60 to the container needs to be strong enough to withstand the weight forces of the fully filled container when carried. Nevertheless, since wood charcoal is lightweight, the handle may be made of corrugated cardboard to provide sufficient strength to withstand the weight forces of the wood charcoal.

Figure 2:
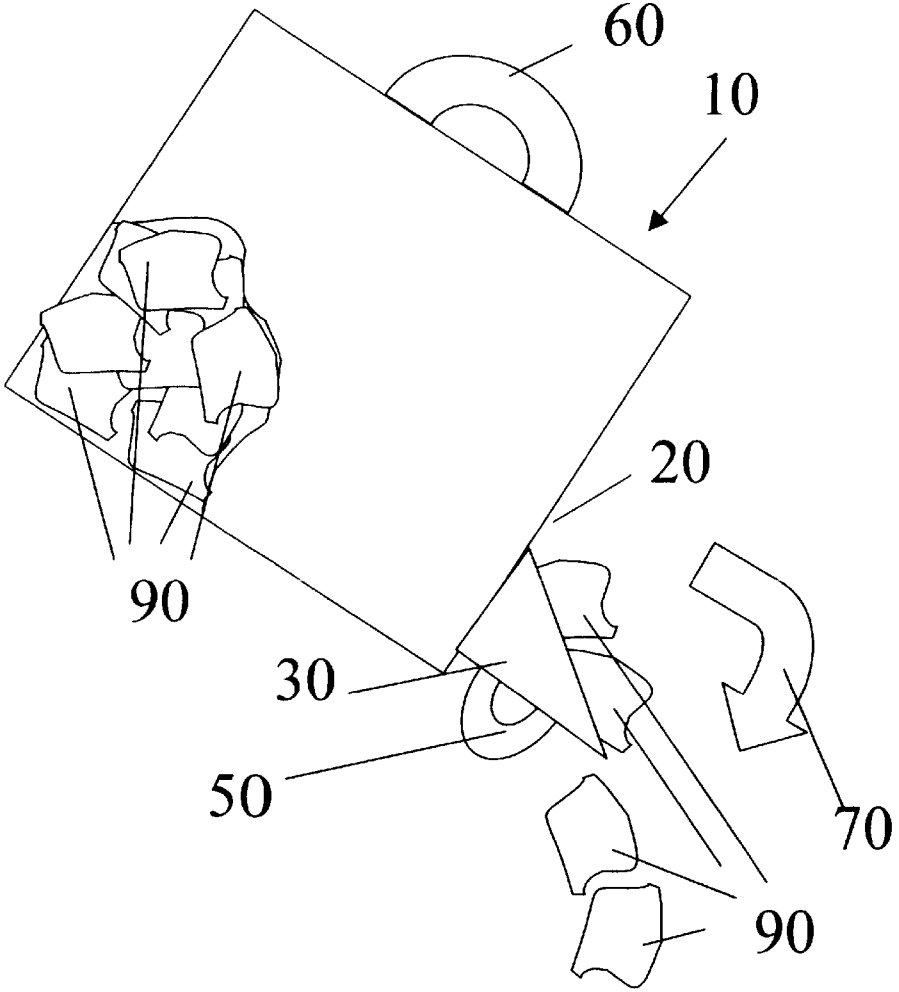
FIG. 2 is a partially broken side view of the wood charcoal container of FIG. 1 showing pouring of wood charcoal out of the container through a spout in an non-collapsed condition.

FIG. 2 illustrates how the wood charcoal container may be used to pour out the stored wood charcoal 90. If the spout 30 is collapsed to close the opening 20, a user may pull in a downward direction 70 on the handle 50 to open the opening 20. The user may then grasp the container 10 by the handle 60 and tilt the container 10 forward at an angle less than ninety degrees to pour out the wood charcoal 90. This contrasts with conventional paper bags that contain charcoal whose openings are at the top since the paper bag must be turned at least 90 degrees to pour out charcoal. Wood charcoal 90 would subsequently exit from the opening 20, down the spout channel created by the semi-rigid walls of the spout 30, and into a receptacle (not shown) such as a barbeque kettle.

Figure 3:
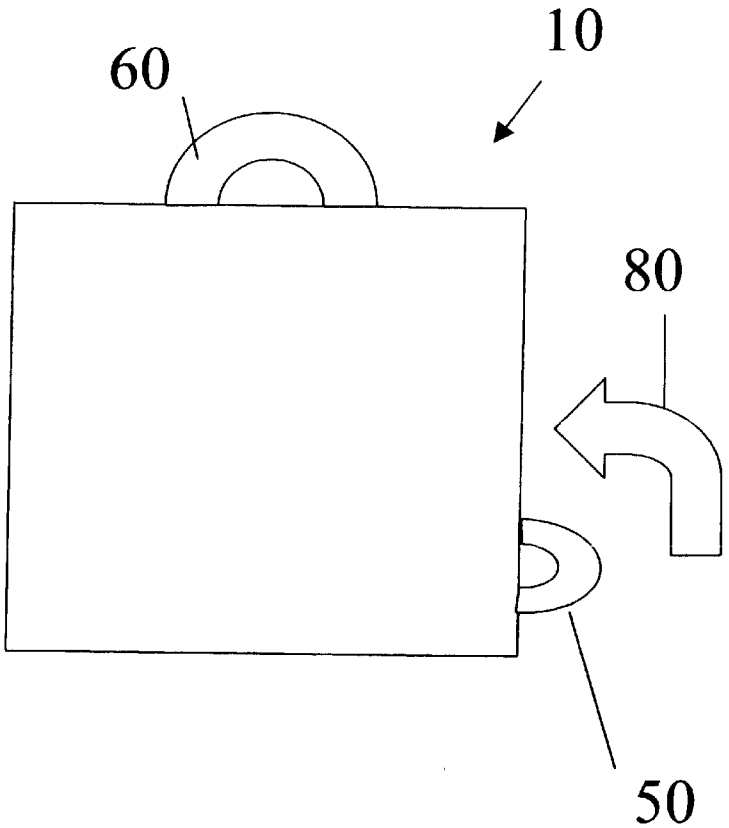
FIG. 3 is an unbroken side view of the wood charcoal container of FIG. 2 but with the spout in a collapsed condition.

FIG. 3 shows how a wood charcoal container 10 may be stored after the user is finished. Once the appropriate amount of wood charcoal has been obtained, a user may close the opening by pushing the handle 50 in an upward direction 80. The spout 30 will subsequently fold upwards, thereby blocking the opening and preventing the exiting of wood charcoal. The container 10 may be then be stored.

Figure 4:
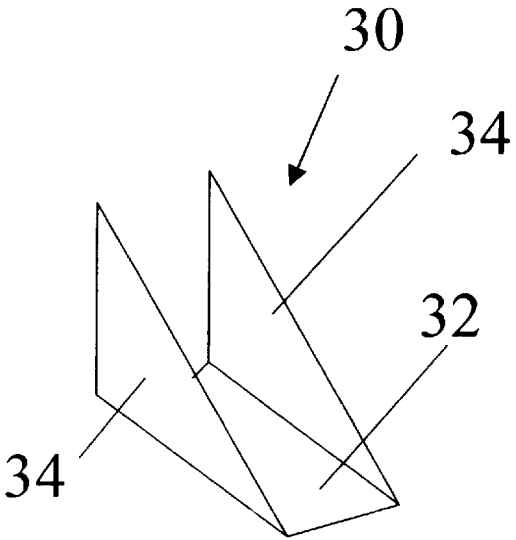
FIG. 4 is a perspective view of the wood charcoal container spout of FIG. 1 in a non-collapsed condition.

FIG. 4 shows one embodiment of the spout 30. The spout 30 may be composed of a bottom wall 32 and two semi-rigid guide walls 34. The combination of the bottom wall 32 and the guide-walls 34 form a spout channel through which wood charcoal may travel.

Figure 5:
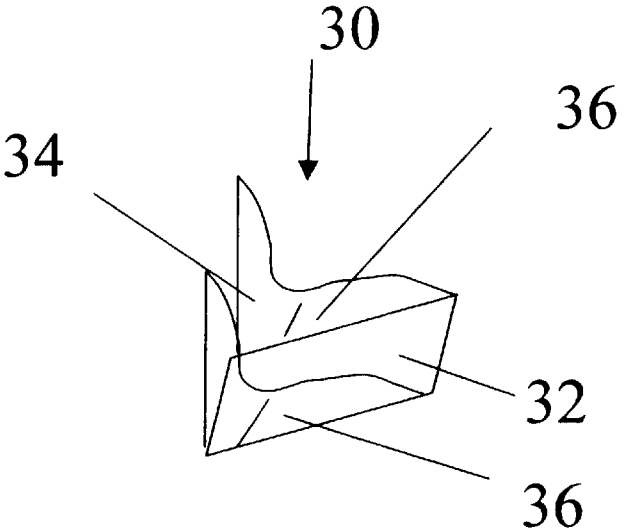
FIG. 5 another perspective view of the wood charcoal container spout of FIG. 1 in a partially collapsed condition.

FIG. 5 shows the guide walls 34, which may be made of a malleable material, each folded at their respective creases 36. To open or close the folding spout 30, the user may simply bend the guide walls 34 at the creases 36.

Figure 6:
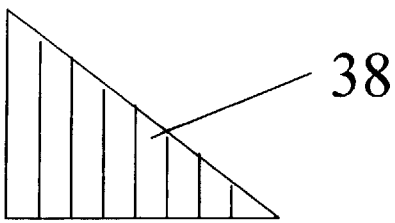
FIG. 6 is a side view of the wood charcoal container spout in accordance with a further embodiment in which the flaps are pleated in an accordian-like manner.

FIG. 6 shows yet another embodiment of the spout 30. In this embodiment, the entire spout has a series of pleats 38 and is made of a malleable material such as corrugated cardboard. Furthermore, the spout is entirely collapsible and extendable by bending at the pleats 38 accordingly.

Figure 7:
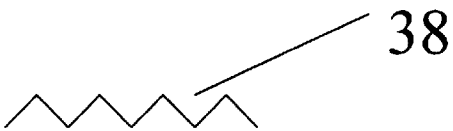
FIG. 7 is an illustration of a top view of one of the spout walls of FIG. 6, but in a partially collapsed condition and folded at each of the pleats.

As best illustrated in FIG. 7, each guide wall of the spout of the embodiment of FIG. 6 is bendable at the pleats 38 in an accordion-like manner. When the guide walls are fully collapsed or compressed, the opening 20 in the container would be blocked, preventing wood charcoal from exiting. The guide walls may be subsequently fully extended outward, thereby opening the opening and creating a spout channel for the wood charcoal.

The handles 50 and 60 are connected to the container by adhesive or by inserting prongs of the handle through holes in the container and bending them to extend along an inside surface of the top wall 14. The prongs may be flattened so that can not be pulled out of the holes and/or be adhesively secured. Alternatively, the handles 50, 60 may be formed integral with the top wall as two elements each extending outwardly from a respective one of the opposite sides of the top wall and then bent at their junction with the top wall to meet each other centrally over the top wall.

Figure 8:
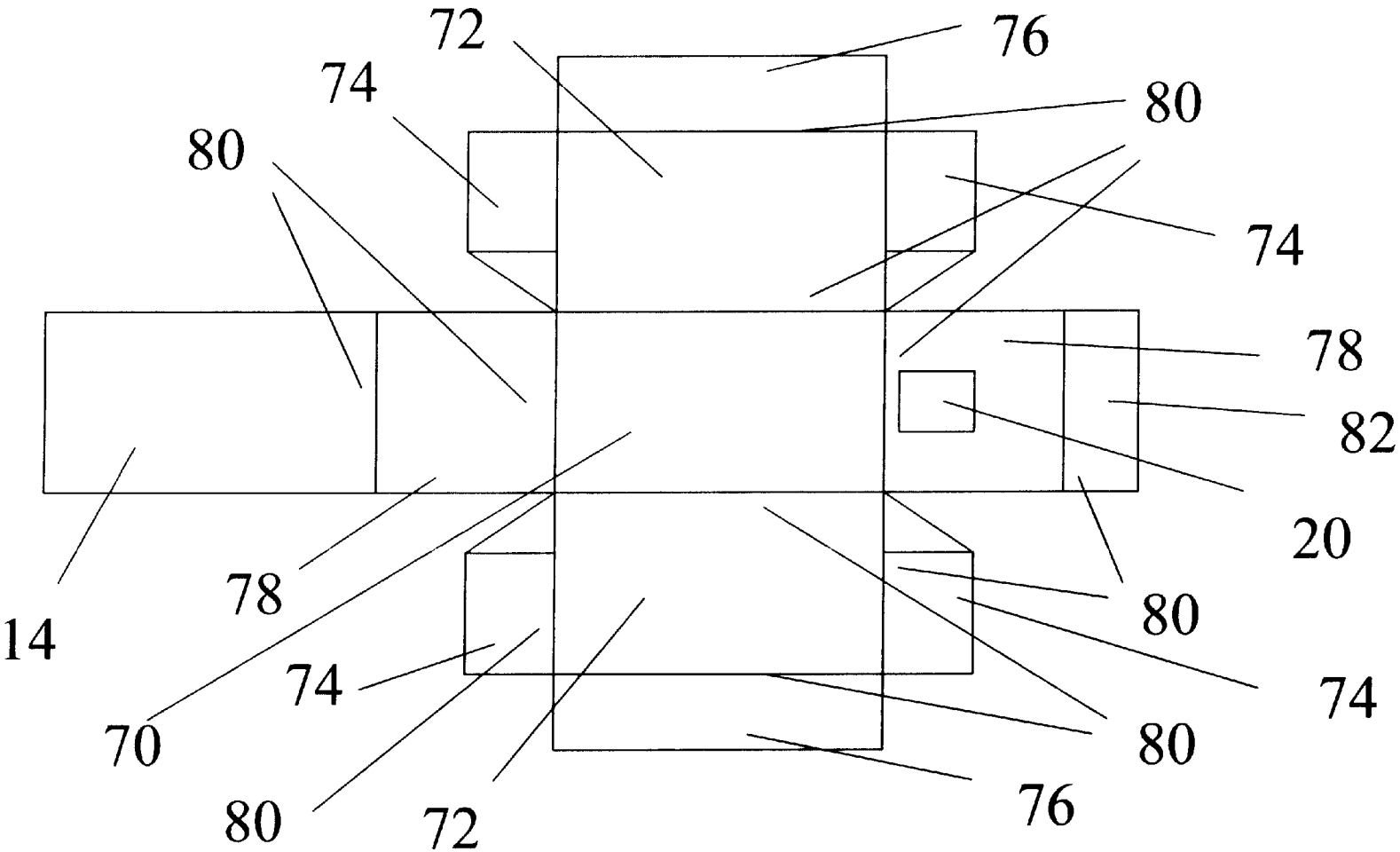
FIG. 8 is a top plan view of a cardboard blank that may be folded into the box shape of FIG. 1.

FIG. 8 shows a cardboard blank that includes a bottom panel 70, two long side panels 72 with flaps 74 and flaps 76, two short side panels 78 one with a flap 82 and a top panel 14 attached to the other of the two short side panels 78. Score lines 80 may be provided on one face of the blank between the side panels 72 and each of the flaps 74 and side flaps 76 and between the flap 82 and the short side panel to which it is attached. Additional score lines may be provided on that same face of the blank between the bottom panel 70 and the long side panels 72 and the short side panels 78 and between the top panel 14 and an adjacent one of the short side panels 78. To form the box of FIG. 1, folding is effected at each of the score lines 80 and an adhesive is applied to the flaps 74 and the flaps 76 on the associated face that will come into contact with another of the panels in the folded condition, i.e., on the face that is the opposite to that shown in FIG. 8 where there are no score lines. That is, all the faces in FIG. 8 will form the interior surfaces of the box.

Prior to securing the top panel 14, the panels are folded at their score lines 80 to form the box shape and an adhesive is applied to the flaps 74 on the non-scored side and secured to the associated short side panel 78 that it contacts. Preferably, the collapsible spout 30 (FIG. 1) is attached to the edge of the opening 20, such as with an adhesive, and the handle 60 is attached to the top panel 14 on the non-scored side, such as with an adhesive. With the top panel 14 still unsecured to the flaps 76, wood charcoal is poured into the interior of the box shape to fill it. After filling, the top panel 14 is secured to the flaps 76, such as with an adhesive.

The adhesive used may be of any type conventionally used to secure cardboard to form boxes and is exemplified by an acrylic based adhesive. Alternatively, other types of fastening, as exemplified by mechanical fasteners such as staples or clips, may be used in place of an adhesive as are known to be used conventionally for such a purpose.

As an alternative to the use of an adhesive or mechanical fasteners, the flaps may be formed to engage in a complementary manner with the sides or top that they will otherwise be adhered to. This may involve the formation of slits or slots through which is inserted the flaps. Such an engagement is of the type known conventionally, as exemplified by U.S. Pat. No. 3,850,362 entitled Container Construction and Method Therefor, whose contents are incorporated herein by reference. The present invention differs from that teaching by providing for a spout and handle and filling the box with wood charcoal.

Preferably the side walls of the spout 30 are collapsible as previously described to close the opening 20, thereby keeping the side walls from entering the interior of the container. Thus, the side walls of the spout 30 do not cut into the friable wood charcoal within the container when the spout 30 closes the opening 20 and will not be pressed by the weight of the wood charcoal that may hinder or prevent the spout from being moved to its outward, extended position.

If desired, the collapsible spout 30 may be identical to that disclosed in U.S. Pat. No. 4,572,408, with suitable expandable fasteners disclosed in U.S. Pat. No. 4,239,149.

There is an advantage in constructing the entire container from wood based products, such as paper or cardboard. Since the contents of the container is wood charcoal, the containers may be fabricated from the same wood supply used as the source for the wood charcoal. Thus, where a portable kiln is brought to a site with a wood supply to generate wood charcoal from scrap waste wood, a portable machine for making paper or cardboard from the same wood supply may be brought to the same site to package the wood charcoal on an as needed basis. Alternatively, the wood charcoal may be manufactured near an existing facility that makes cardboard or paper and use waste wood to generate wood pulp.

While the foregoing description and drawings represent the preferred embodiments of the present invention, it will be understood that various changes and modifications may be made without departing from the spirit and scope of the present invention.

What is claimed is:

1. A filled wood charcoal container, comprising an enclosure having a box-shape with a plurality of walls including a top wall, a front wall and a bottom wall, the front wall having an opening situated closer to the bottom wall than to the top wall, the front wall spacing the top wall from the bottom wall; a collapsible spout movable between a collapsed position that closes the opening and an extended position clear of the opening, the spout having guide walls that fold in response to externally applied forces that collapse the spout; and a handle connected to the container and defining a space between the handle and the top wall, the enclosure being filled with wood charcoal.

2. The container of claim 1, wherein said guide walls that bend at creases in the collapsed condition.

3. The container of claim 1, wherein the spout has a base between the guide walls, further comprising a handle attached to the base.

4. The container of claim 1, wherein the enclosure and the handle are made of corrugated cardboard, the spout being made of a material selected from a group consisting of cardboard and paper.

* * * * *